US011796962B2

(12) United States Patent
Villar

(10) Patent No.: US 11,796,962 B2
(45) Date of Patent: Oct. 24, 2023

(54) ESCAPEMENT MECHANISM OF A TIMEPIECE

(71) Applicant: ETA SA MANUFACTURE HORLOGÈRE SUISSE, Grenchen (CH)

(72) Inventor: Ivan Villar, Brügg (CH)

(73) Assignee: ETA SA MANUFACTURE HORLOGÈRE SUISSE, Grenchen (CH)

( * ) Notice: Subject to any disclaimer, the term of this patent is extended or adjusted under 35 U.S.C. 154(b) by 298 days.

(21) Appl. No.: 17/182,350

(22) Filed: Feb. 23, 2021

(65) Prior Publication Data

US 2021/0333758 A1 Oct. 28, 2021

(30) Foreign Application Priority Data

Apr. 23, 2020 (EP) ..... 20171015

(51) Int. Cl.

| | |
|---|---|
| ***G04B 15/14*** | (2006.01) |
| ***G04B 13/02*** | (2006.01) |
| ***G04B 15/08*** | (2006.01) |
| ***G04B 17/06*** | (2006.01) |

(52) U.S. Cl.

CPC ..... *G04B 15/14* (2013.01); *G04B 13/02* (2013.01); *G04B 15/08* (2013.01); *G04B 17/06* (2013.01)

(58) Field of Classification Search

CPC ..... G04B 15/14; G04B 13/02; G04B 15/08; G04B 17/06

See application file for complete search history.

(56) References Cited

U.S. PATENT DOCUMENTS

2011/0310709 A1* 12/2011 Vaucher ..... G04B 15/08 368/127

FOREIGN PATENT DOCUMENTS

| | | | | |
|---|---|---|---|---|
| CH | 706 543 A2 | | 11/2013 | |
| CH | 706543 A2 | * | 11/2013 | ..... G04B 15/14 |
| CH | 708 390 A2 | | 1/2015 | |
| CH | 709 329 A2 | | 9/2015 | |
| CH | 709329 A2 | * | 9/2015 | ..... G04B 15/08 |
| CH | 709609 B1 | * | 4/2018 | ..... F16H 55/06 |
| CH | 715093 A2 | | 12/2019 | |

(Continued)

OTHER PUBLICATIONS

European Search Report for EP 20 17 1015 dated Sep. 24, 2020.

(Continued)

*Primary Examiner* — Edwin A. Leon
*Assistant Examiner* — Kevin Andrew Johnston
(74) *Attorney, Agent, or Firm* — Sughrue Mion, PLLC

(57) ABSTRACT

An escapement mechanism of a timepiece, including: a first escapement wheel, a second escapement wheel called an impulse pinion and a drive pinion; the impulse pinion, the drive pinion and the first escapement wheel being mounted on the same axis; an intermediate wheel meshing with the drive pinion; a balance plate carrying a plate peg and a direct impulse pallet stone arranged to cooperate with the first escapement wheel; pallets including a pallet entry cooperating with the plate peg, an impulse pallet stone arranged to cooperate with the impulse pinion, and first and second support pallet stones arranged to cooperate with the first escapement wheel. The first escapement wheel, the drive pinion and the impulse pinion are mounted in this order.

8 Claims, 3 Drawing Sheets

(56) References Cited

FOREIGN PATENT DOCUMENTS

| | | | |
|---|---|---|---|
| CN | 102063049 | A | 5/2011 |
| EP | 0018796 | A2 | 11/1980 |
| EP | 1 045 297 | A1 | 10/2000 |
| EP | 2 506 091 | A2 | 10/2012 |
| JP | 28-2146 | A | 5/1953 |
| JP | 29-1078 | A | 3/1954 |
| JP | 2019-219249 | A | 12/2019 |

OTHER PUBLICATIONS

"Omega Co-Axial Escapement Explained", YouTube online video published Jun. 29, 2017 (1 page total) Accessed via the internet: https://www.youtube.com/watch?v=3mJDk4e_AbU.

* cited by examiner

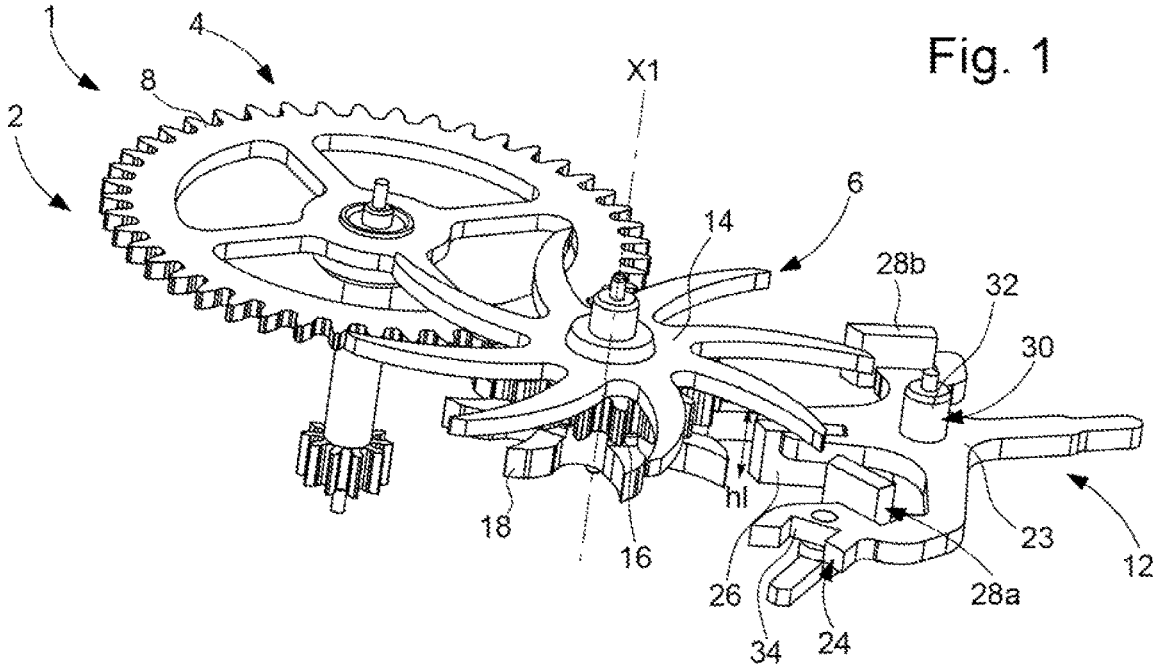
Fig. 1
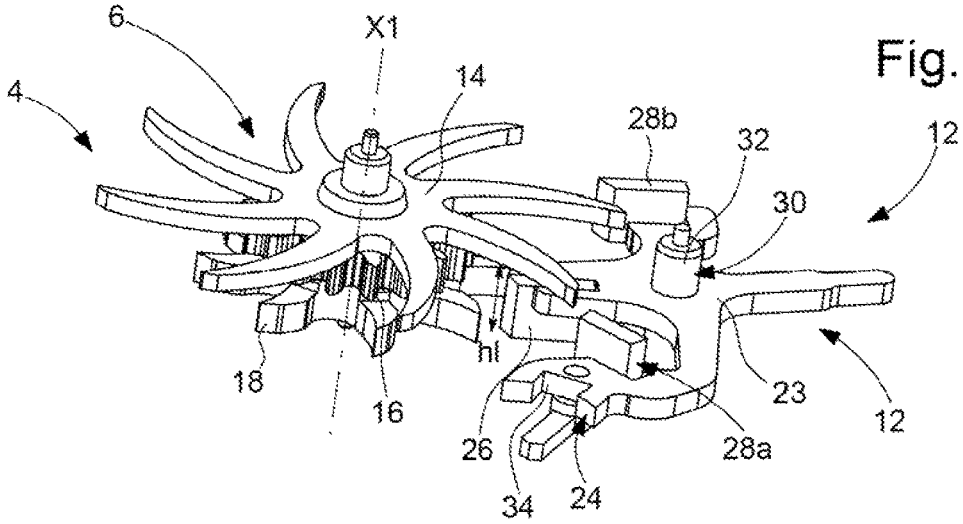
Fig. 2
Fig. 3a
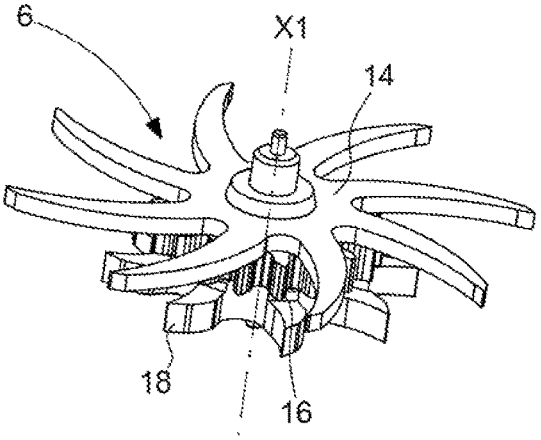
Fig. 3b
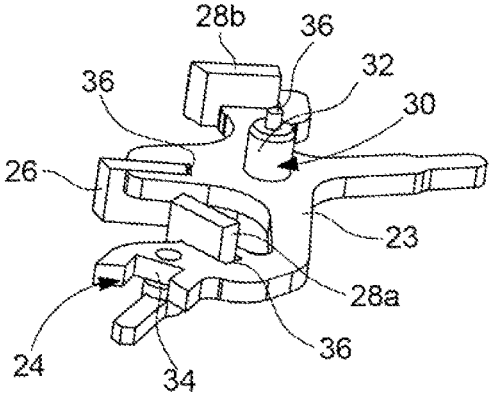

ESCAPEMENT MECHANISM OF A TIMEPIECE

CROSS-REFERENCE TO RELATED APPLICATIONS

This application claims priority to European Patent Application No. 20171015.9 filed Apr. 23, 2020, the entire contents of which are incorporated herein by reference.

TECHNICAL FIELD

The invention relates to an escapement mechanism for a timepiece.

The invention also relates to a horological movement comprising such an escapement mechanism.

Finally, the invention relates to a timepiece comprising such a horological movement. The timepiece is for example a watch or a clock.

TECHNOLOGICAL BACKGROUND

In the field of horological movements, systems fulfilling the escapement function are known. The escapement is conventionally placed between the energy source of the horological movement and the oscillator of the balance spring type. The purpose of the escapement is to count and maintain the oscillations of the balance spring. Typically, using an escapement of the Swiss pallets type in certain mechanical watches is known. Such an escapement with Swiss pallets comprises an escapement wheel (also referred to as a pallets wheel), pallets provided with entry and exit lifts, and a double plate. The Swiss-pallets escapement transmits the forces from the pallets wheel to the balance through lever effects and sliding inclined planes of the pallets wheel on the pallets. The teeth of the pallets wheel thus fulfil a function of impulse on the pallets lifts. However, such a force transmission principle is also the weak point of this type of escapement. Maintaining the friction conditions on sliding planes in fact involves very tricky lubrication systems that are sensitive to ageing. This constitutes an important factor in the variation of the running and is thus liable to cause running that is unstable in the positions. Furthermore, such an escapement of the Swiss pallets type necessitates having very high amplitudes when new.

In order to remedy these drawbacks, one known solution consists of providing a coaxial escapement system with pallets in the horological mechanism. In addition to the pallets, the system typically comprises a triple coaxial wheel including a first escapement wheel, a second escapement wheel (also referred to as an impulse pinion) and a drive pinion mounted coaxially in this order. The system also comprises an intermediate wheel meshing with the drive pinion; and a balance plate, secured to a balance spring. The balance plate carries a plate peg and a direct impulse pallet stone arranged to cooperate with the first escapement wheel. The pallets include a pallets entry cooperating with the plate peg, an impulse pallet stone arranged to cooperate with the impulse pinion, and support pallet stones arranged to cooperate with the first escapement wheel. The coaxial escapement system with pallets transmits the energy to the balance spring in the clockwise and anticlockwise directions of the oscillations of the balance. An impulse is transmitted in the clockwise direction directly from a tooth of the first escapement wheel to the plate. In the anticlockwise direction is impulse is delivered to the plate via the pallets, or more precisely via the action of a tooth of the impulse pinion on the impulse pallet stone of the pallets, and then of the pallets entry on the plate peg. After the impulses, the first escapement wheel is resting on the support pallet stones and the balance performs its oscillations freely, without interference.

Via its system of tangential transmission of the force, such a coaxial escapement mechanism is not dependent on lubrication for maintaining the operating conditions of the mechanism. This system in fact functions as gears and, for transmission of the force, does not require any lubrication. An important variation factor is consequently eliminated and contributes to a relatively stable running in the movement. Such a coaxial escapement mechanism furthermore allows a transmission of the balance-spring maintenance force that is constant over time, and allows constant maintenance of the amplitude thereof. It is thus no longer necessary, unlike the escapement of the Swiss pallets type, to have very high amplitudes when new. Errors in running in the positions are thus reduced. Finally, this coaxial escape mechanism allows a profitable reduction in the angle of lift of the balance compared with the Swiss pallets escapement. The angle of lift is in fact reduced from 52 degrees for the Swiss pallets escapement to 37 degrees for the coaxial escapement. This ensures less disturbance of the balance at each vibration of the latter, compared with the Swiss pallets escapement. The result is consistency of the qualities of setting of the watch and precision thereof. Such a coaxial escapement mechanism is therefore particularly intended for manufacturing high-precision chronometers.

However, this type of coaxial escapement mechanism is relatively bulky, which is prejudicial to the compactness of the whole. In order to respond to this problem, the patent document EP 1 045 297 A1 proposes a coaxial escapement system with double coaxial wheel. Apart from the pallets, the system described in this document comprises in fact a double coaxial wheel including a first escapement wheel and a second escapement wheel. The system also comprises an intermediate wheel meshing with the second escapement wheel. The pallets include a pallets entry cooperating with the plate peg, an impulse pallet stone arranged to cooperate with the second escapement wheel, and support pallet stones arranged to cooperate with the first escapement wheel. The second escapement wheel fulfils a double function: that of drive pinion meshing with the intermediate wheel and that of escapement wheel cooperating with the impulse pallet stone of the pallets. This makes it possible, by saving on the presence of a component in the coaxial wheel, to reduce the height of the assembly and therefore to improve the compactness thereof. However, one defect with this solution is that the number of teeth on the drive pinion must be identical to the number of teeth on the second escapement wheel. In addition, it is necessary to ensure that the two tooth profiles of the second escapement wheel, the one that meshes with the tooth on the drive pinion, and the one that works with the impulse pallet stone, do not interfere with each other. Optimisation of the two profiles is therefore a constraint. Moreover, a coaxial escapement with triple coaxial wheel necessitates, through its configuration, constraints with regard to the volume of the balance, and therefore with regard to the inertia of the latter. However, limiting the inertia of the balance does not make it possible to obtain optimum quality of isochronism for the horological movement, nor to completely eliminate the variations in running in the movement.

SUMMARY OF THE INVENTION

The purpose of the invention is therefore to provide an escapement mechanism for a timepiece that includes a horological movement provided with a balance, making it possible to increase the inertia of the balance while limiting the space requirement and the global volume of the movement, and while keeping the entire latitude of optimisation with regard to the number of teeth and the profile of the drive pinion.

For this purpose, the invention relates to an escapement mechanism of a timepiece, which comprises the features mentioned in independent claim 1.

Particular forms of the escapement mechanism are defined in dependent claims 2 to 5.

By virtue of the particular configuration between the first escapement wheel, the drive pinion and the impulse pinion, or more precisely because these elements are mounted coaxially in this order, the escapement mechanism according to the invention makes it possible to lower the disc of the intermediate wheel (which is typically the seconds wheel for a watch) in the horological movement. This advantageously releases space in the movement, which makes it possible to increase the volume and therefore the inertia of the balance. The quality of the isochronism is consequently improved in the horological movement, and the variations in running reduced, while obtaining a very compact setting for the escapement mechanism.

Advantageously, the impulse pallet stone of the pallets has a height such that said impulse pallet stone extends level with the teeth of the impulse pinion. This allows meshing between the pallets and the impulse pinion.

For this purpose, the invention also concerns a horological movement including the escapement mechanism and which comprises the features mentioned in dependent claim 8.

For this purpose, the invention also concerns a timepiece including the horological movement described above, and which comprises the features mentioned in dependent claim 9.

BRIEF DESCRIPTION OF THE FIGURES

The aims, advantages and features of the coaxial escapement mechanism for a timepiece according to the invention will appear more clearly in the following description on the basis of at least one non-limitative embodiment illustrated by the drawings, on which:

FIG. 1 is a perspective view from below of a part of a horological movement of a watch comprising an escapement mechanism according to the invention;

FIG. 2 is a perspective view from below of a part of the coaxial escapement mechanism of FIG. 1, the coaxial escapement mechanism comprising a triple coaxial wheel and pallets;

FIG. 3*a* is a perspective view from below of the triple coaxial wheel of FIG. 2;

FIG. 3*b* is a perspective view from below of the pallets of FIG. 2;

DETAILED DESCRIPTION OF THE INVENTION

In the following description, reference is made to a horological movement provided with an escapement mechanism, preferably coaxial, for an oscillator of the balance spring type. The usual components of the horological movement, which are well known to a person skilled in this technical field, are described only in a simplified manner or not described at all. A person skilled in the art will in fact be able to adapt these various components and to make them cooperate for the functioning of the horological movement. In particular, everything that relates to the oscillator of the balance spring type will not be described hereinafter, although such a balance spring can advantageously cooperate with the coaxial escapement mechanism according to the invention.

FIGS. 1, 4*a*, 4*b* and 5 show a part of a timepiece 1, which comprises a horological movement 2. The timepiece 1 is typically a watch or a clock.

The horological movement 2 includes an oscillator provided with a balance and a balance spring (not shown), an energy source (not shown) and an escapement mechanism 4 placed between the energy source and the oscillator.

Figure 4A:
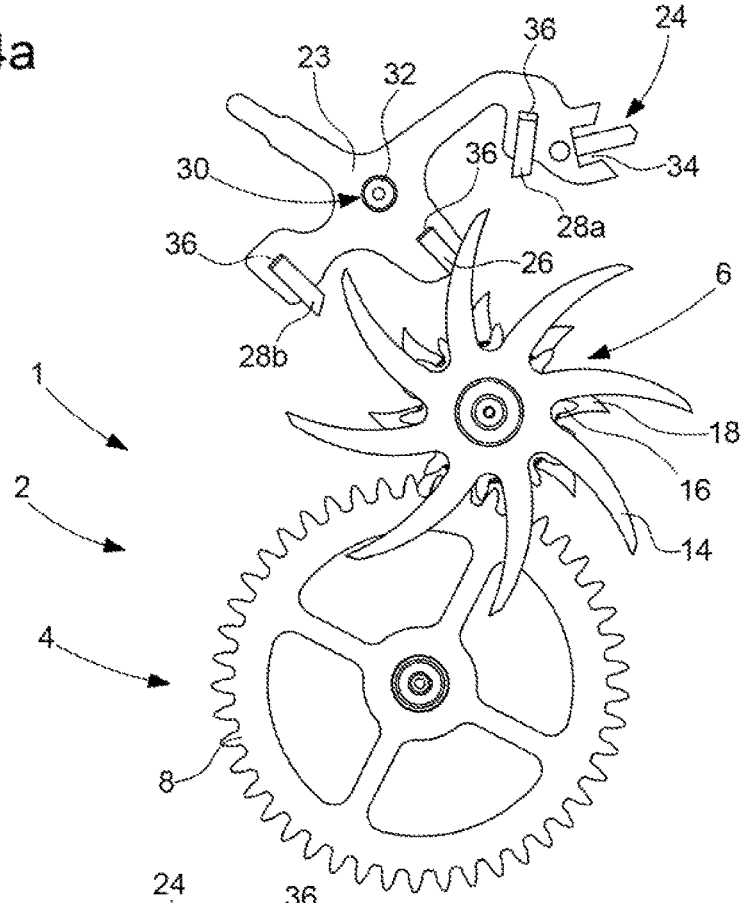
FIG. 4*a* is a plan view of the escapement mechanism of FIG. 1.
Figure 4B:
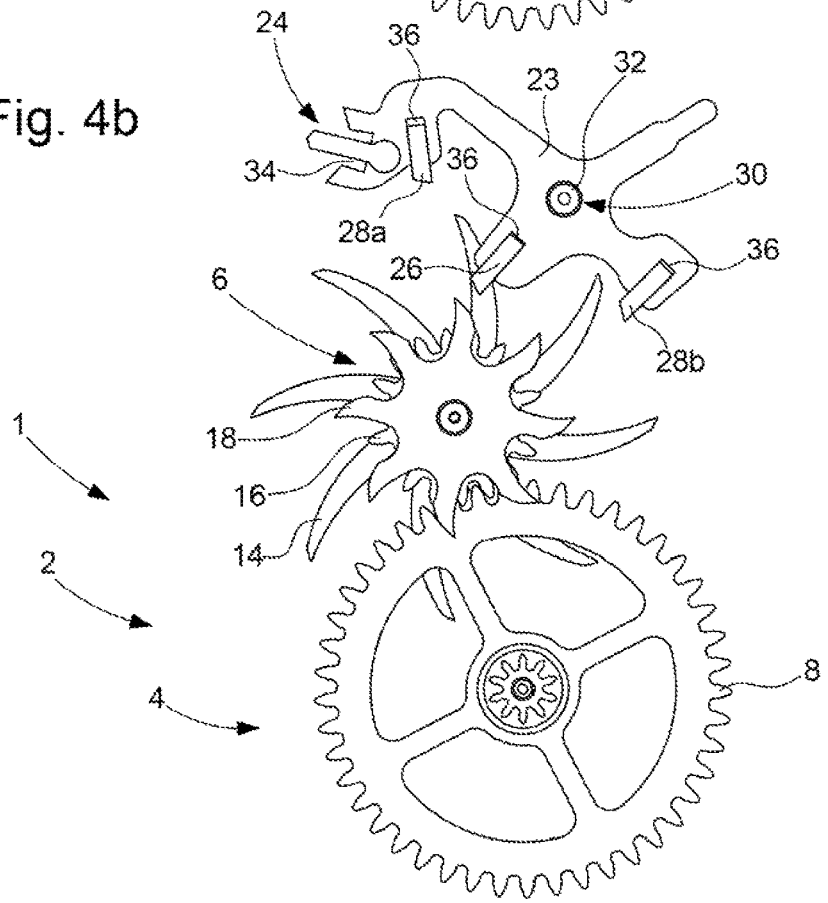
FIG. 4*b* is a view from below of the escapement mechanism of FIG. 1.
Figure 5:
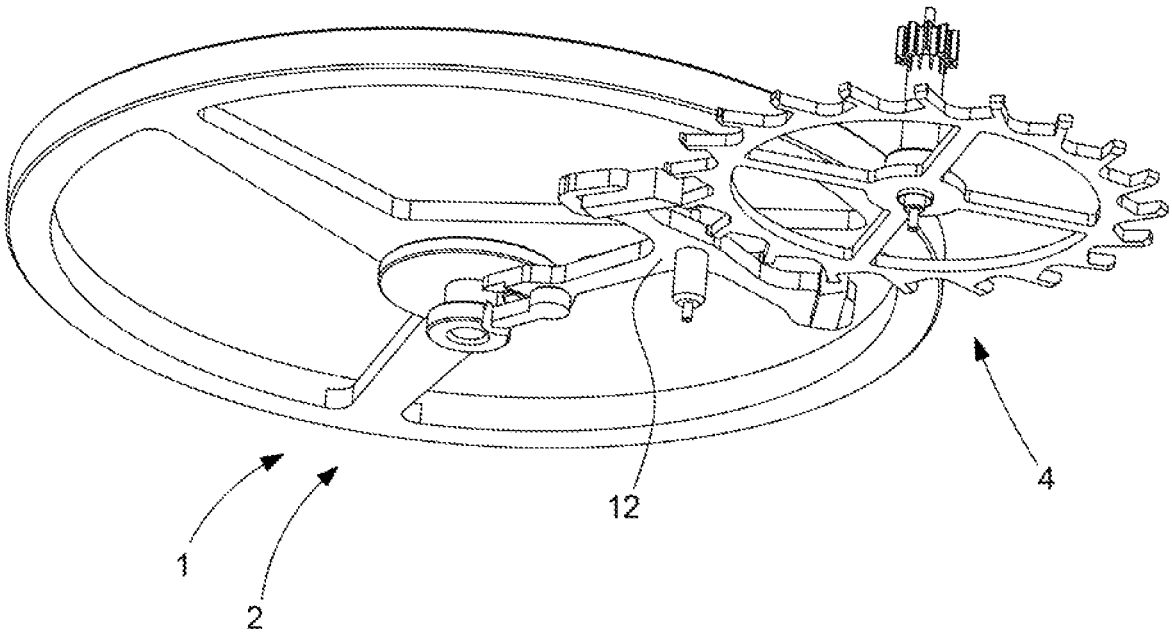
FIG. 5 illustrates a perspective view from below of the escapement mechanism according to another embodiment.

The escapement mechanism illustrated in FIGS. 1 to 4*b* is a coaxial escapement 4, and comprises a triple coaxial wheel 6, an intermediate wheel 8, a balance plate (not shown) and pallets 12. The escapement mechanism illustrated in FIG. 5 is a conventional escapement including two levels with pallets 12, an escapement wheel and a balance.

The triple coaxial wheel 6 includes a first escapement wheel 14, a drive pinion 16 and a second escapement wheel 18 called an impulse pinion. As can be seen in FIGS. 1 to 3*a* (on which the escapement mechanism 4 is seen from below with respect to the normal arrangement thereof in the movement 2), the first escapement wheel 14, the drive pinion 16 and the impulse pinion 18 are mounted on the same axis X1. More precisely, the first escapement wheel 14, the drive pinion 16 and the impulse pinion 18 are mounted coaxially, in this order, on the axis X1. In other words, the drive pinion 16 is mounted coaxially on the first escapement wheel 14, and the impulse pinion 18 is mounted coaxially on the drive pinion 16. It will thus be understood that, through this particular arrangement between the first escapement wheel 14, the drive pinion 16 and the impulse pinion 18, the coaxial escapement mechanism 4 according to the invention advantageously makes it possible to lower the disc (not shown) of the intermediate wheel 8 in the horological movement 2, level with the drive pinion 16. This advantageously releases space in the horological movement 2, which makes it possible to increase the volume and therefore the inertia of the balance. The quality of isochronism is consequently improved in the horological movement 2, and the variations in running reduced, while obtaining very compact setting for the escapement mechanism 4.

The intermediate wheel 8 meshes with the drive pinion 16, and transmits the motive force to the latter. The intermediate wheel 8 may be the last wheel in the finishing train driven by the barrel of the horological movement 2, typically the seconds wheel.

The balance plate (which is not shown in the figures) is secured to the oscillator formed by the balance and the balance spring. The balance plate carries a plate peg and a direct impulse pallet stone (neither being shown). Preferably, the plate peg is made from ruby. The direct impulse pallet stone is arranged to cooperate with the teeth of the first escapement wheel 14. Preferably, the direct impulse pallet stone consists of a lift made from ruby.

As illustrated in FIGS. 1, 2 and 3*b*, the pallets 12 include a support 23, a pallets entry 24, an impulse pallet stone 26, and first and second support pallet stones 28*a*, 28*b*. The pallets 12 are mounted pivotably in the horological movement 2. More precisely, the support 23 of the pallets 12 includes a shaft 30 provided with pivots 32, preferentially lubricated. Preferably, as can be seen in FIGS. 1 and 2, the pallets are coplanar with the drive pinion 16. The pallets entry 24 cooperates with the plate peg. To do this, the pallets entry 24 comprises for example a fork 34 configured to cooperate with the plate peg. The impulse pallet stone 26 is arranged to cooperate with the teeth of the impulse pinion 18. Preferably, as illustrated in FIGS. 1 and 2, the impulse pallet stone 26 has a height h1 such that the impulse pallet stone 26 extends level with the teeth of the impulse pinion 18, opposite to the support pallet stones 28*a*, 28*b* with respect to the support 23, the height being measured along the axis X1.

The first and second support pallet stones 28*a*, 28*b* extend alongside the first escapement wheel 14, and are each arranged to cooperate with the teeth on the first escapement wheel 14. Preferably, the impulse pallet stone 26 and/or the first and second support pallet stones 28*a*, 28*b* each consist of a ruby lift. More precisely, as illustrated in FIGS. 1 to 4*b*, each of the pallet stones 26, 28*a*, 28*b* is made from a single-piece ruby stone engaged in a groove 36 formed in the thickness of the pallets 12.

The invention also relates to a horological movement 2 comprising an escapement mechanism 4 as described previously and a balance spring, the balance plate of the coaxial escapement mechanism 4 being secured to the balance spring.

The invention also relates to a timepiece 1 comprising such a horological movement 2.

The invention claimed is:

1. An escapement mechanism of a timepiece, comprising:

a first escapement wheel, a second escapement wheel called an impulse pinion and a drive pinion; the impulse pinion, the drive pinion and the first escapement wheel being mounted on the same axis;

an intermediate wheel meshing with the drive pinion;

a balance plate carrying a plate peg and a direct impulse pallet stone arranged to cooperate with the first escapement wheel;

pallets including a pallet entry cooperating with the plate peg, an impulse pallet stone arranged to cooperate with the impulse pinion, and first and second support pallet stones arranged to cooperate with the first escapement wheel;

wherein the first escapement wheel, the drive pinion and the impulse pinion are mounted in this order.

2. The escapement mechanism according to claim 1, wherein the pallets are coplanar with the drive pinion.

3. The escapement mechanism according to claim 1, wherein the impulse pallet stone of the pallets has a height (h1) such that said impulse pallet stone extends level with the teeth of the impulse pinion.

4. The escapement mechanism according to claim 1, wherein at least one from among the direct impulse pallet stone of the balance plate, the impulse pallet stone of the pallets and the support pallet stones of the pallets consists of a ruby lift.

5. The escapement mechanism according to claim 1, wherein the plate peg is made from ruby.

6. The escapement mechanism according to claim 1, wherein the escapement mechanism is a coaxial escapement.

7. A horological movement comprising the escapement mechanism of claim 1 and a balance spring, wherein the balance plate of the escapement mechanism is secured to the balance spring.

8. A timepiece comprising the horological movement of claim 7.

* * * * *